US007367656B2

(12) United States Patent
Cho et al.

(10) Patent No.: US 7,367,656 B2
(45) **Date of Patent: *May 6, 2008**

(54) INK-JET PRINTHEAD AND METHOD FOR MANUFACTURING THE SAME

(75) Inventors: Chang-ho Cho, Suwon-si (KR); Yong-soo Oh, Seongnam-si (KR); Keon Kuk, Yongin-si (KR); Jong-woo Shin, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 452 days.

This patent is subject to a terminal disclaimer.

(21) Appl. No.: 10/773,289

(22) Filed: Feb. 9, 2004

(65) Prior Publication Data

US 2004/0155930 A1 Aug. 12, 2004

(30) Foreign Application Priority Data

Feb. 8, 2003 (KR) ..... 10-2003-0008005

(51) Int. Cl.
*B41J 2/05* (2006.01)

(52) U.S. Cl. ..... 347/61

(58) Field of Classification Search ..... 347/56, 347/61, 62

See application file for complete search history.

(56) References Cited

U.S. PATENT DOCUMENTS 5,710,070 A * 1/1998 Chan ..... 438/21
5,760,804 A 6/1998 Heinzl et al. ..... 347/56
5,841,452 A * 11/1998 Silverbrook ..... 347/47
6,003,977 A 12/1999 Weber et al.
6,019,457 A 2/2000 Silverbrook ..... 347/65
6,412,918 B1 * 7/2002 Chen et al. ..... 347/56
6,478,408 B2 11/2002 Lee et al. ..... 347/56
6,561,625 B2 5/2003 Maeng et al.
6,561,626 B1 * 5/2003 Min et al. ..... 347/47
6,806,108 B2 * 10/2004 Park et al. ..... 438/21
6,886,919 B2 * 5/2005 Lim et al. ..... 347/56
2002/0008738 A1 * 1/2002 Lee et al. ..... 347/62

FOREIGN PATENT DOCUMENTS

EP 1 221 374 A2 7/2002
EP 1 221 374 A3 7/2002
JP 2001-105590 4/2001
JP 2002-200757 7/2002

* cited by examiner

*Primary Examiner*—An H. Do
(74) *Attorney, Agent, or Firm*—Lee & Morse, P.C.

(57) ABSTRACT

In an ink-jet printhead and a method for manufacturing the same, the ink-jet printhead includes a substrate, an ink chamber to be filled with ink to be ejected formed on an upper surface of the substrate, a restrictor, which is a path through which ink is supplied from an ink reservoir to the ink chamber, perforating a bottom surface of the substrate and a bottom surface of the ink chamber, a nozzle plate, which is stacked on the upper surface of the substrate and forms an upper wall of the ink chamber, a nozzle perforating the nozzle plate at a position corresponding to a center of the ink chamber, a heater formed in the nozzle plate to surround the nozzle, and a conductor for applying a current to the heater.

13 Claims, 11 Drawing Sheets

INK-JET PRINTHEAD AND METHOD FOR MANUFACTURING THE SAME

BACKGROUND OF THE INVENTION

1. Field of the Invention

The present invention relates to an ink-jet printhead and a method for manufacturing the same. More particularly, the present invention relates to an ink-jet printhead having improved efficiency and performance, and a method for manufacturing the same.

2. Description of the Related Art

Typically, ink-jet printheads are devices for printing a predetermined image, color or black, by ejecting a small volume droplet of printing ink at a desired position on a recording sheet. Ink-jet printheads are largely categorized into two types depending on which ink droplet ejection mechanism is used. A first type is a thermally driven ink-jet printhead in which a heat source is employed to form and expand bubbles in ink causing ink droplets to be ejected. A second type is a piezoelectrically driven ink-jet printhead in which a piezoelectric material deforms to exert pressure on ink causing ink droplets to be ejected.

Hereinafter, the ink ejection mechanism in the thermally driven ink-jet printhead will be described in greater detail. When a pulse current flows through a heater formed of a resistance heating material, the heater generates heat and ink adjacent to the heater is instantaneously heated to about 300° C., thereby boiling the ink. The boiling of the ink causes bubbles to be generated, expand, and apply pressure to an interior of an ink chamber filled with ink. As a result, ink near a nozzle is ejected from the ink chamber in droplet form through the nozzle.

The thermal driving method includes a top-shooting method, a side-shooting method, and a back-shooting method depending on a growth direction of bubbles and an ejection direction of ink droplets.

The top-shooting method is a method in which the growth direction of bubbles is the same as the ejection direction of ink droplets. The side-shooting method is a method in which the growth direction of bubbles is perpendicular to the ejection direction of ink droplets. The back-shooting method is a method in which the growth direction of bubbles is opposite to the ejection direction of ink droplets.

The ink-jet printheads using the thermal driving method should satisfy the following requirements. First, manufacturing of the ink-jet printheads should be simple, costs should be low, and should facilitate mass production thereof. Second, in order to obtain a high-quality image, cross talk between adjacent nozzles should be suppressed while a distance between adjacent nozzles should be narrow; that is, in order to increase dots per inch (DPI), a plurality of nozzles should be densely positioned. Third, in order to perform a high-speed printing operation, a period in which the ink chamber is refilled with ink after being ejected from the ink chamber should be as short as possible and the cooling of heated ink and heater should be performed quickly to increase a driving frequency.

FIGS. 1 through 4 illustrate various structures of conventional ink-jet printheads using the back-shooting method.

FIG. 1 illustrates a separated perspective view of a conventional ink-jet printhead. Referring to FIG. 1, the ink-jet printhead has a structure in which a substrate 36, on which a nozzle 32 and an ink chamber 34 are formed, is stacked on an ink reservoir 30, in which an ink supply conduit 31 is formed. In this printhead, a heater is disposed around the nozzle 32, although the heater is not shown in FIG. 1.

In the above structure, when a pulse current is applied to the heater and the heater generates heat, ink in the ink chamber 34 is boiled, and bubbles are generated. The bubbles expand continuously and apply a pressure to ink in the ink chamber 34. This pressure causes ink to be ejected in droplet form through the nozzle 32.

In the ink-jet printhead using the back-shooting method, in order to effectively use energy of a bubble in a direction of ink ejection, flow resistance should be large so that the flow of ink is suppressed in a direction of bubble growth.

However, an element of the printhead for creating flow resistance between the ink chamber 34 and the ink reservoir 30 does not exist in the aforementioned ink-jet printhead. Accordingly, flow in the direction of bubble growth cannot be restricted. Thus, a larger amount of energy is required to be generated in the direction of bubble growth in order to eject ink. In addition, since a height of the ink chamber 34 is almost the same as a thickness of the substrate 36, a size of the ink chamber 34 is increased unless a very thin substrate is used. As a result, an amount of ink affected by bubbles is increased. This means that an inertia force of ink is increased, and an operating frequency of the printhead is restricted by the inertia force of ink.

FIG. 2 illustrates a cross-sectional view of a structure of another conventional ink-jet printhead. Referring to FIG. 2, a nozzle 42 is formed at one end of an ink channel 40 through which ink flows, and a heater 44 is disposed around the nozzle 42. The ink channel 40 has a shape such that a sectional area thereof gradually increases in a direction of bubble growth.

In the aforementioned ink-jet printhead, flow resistance is reduced in the direction of bubble growth. Accordingly, a larger bubble energy is required to eject ink.

FIG. 3 illustrates a cross-sectional view of another structure of a conventional ink-jet printhead. Referring to FIG. 3, a substantially hemispheric ink chamber 50 is formed in a substrate 65, and a manifold 54 for supplying ink to the ink chamber 50 is formed under the substrate 65. An ink channel 52 for providing communication between the ink chamber 50 and the manifold 54 is formed on a bottom center of the ink chamber 50. A nozzle plate 60, in which a nozzle 58 is formed, is stacked on a top surface of the substrate 65. The nozzle plate 60 forms an upper wall of the ink chamber 50. A heater 56 is formed in the nozzle plate 60 and surrounds the nozzle 58.

FIG. 4 illustrates a cross-sectional view of a structure of yet another conventional ink-jet printhead. Referring to FIG. 4, an ink chamber 72, which has a substantially hemispherical shape and is to be filled with ink, and an ink channel 74, which is formed to a smaller depth than the ink chamber 72 and supplies ink to the ink chamber 72, are formed on a surface of a substrate 70. A manifold 76 for supplying ink to the ink channel 74 is formed on a bottom surface of the substrate 70. A nozzle plate 80 formed of a plurality of material layers is stacked on an upper surface of the substrate 70 and forms an upper wall of the ink chamber 72. A nozzle 78, through which ink is ejected, is formed in a position of the nozzle plate 80 corresponding to a center of the ink chamber 72. A ring-shaped heater 82 is formed around the nozzle 78 and surrounds the nozzle 78. A nozzle guide 84 is additionally formed in this printhead. The nozzle guide 84 guides an ejection direction of ink and ejects ink droplets to be precisely perpendicular to the upper surface of the substrate 70.

As described above, the conventional ink-jet printheads shown in FIGS. 3 and 4 have a structure in which a manifold is formed between an ink channel and an ink reservoir. However, in the previous ink-jet printhead, it is not easy to process an ink channel. In addition, even though the ink channel may be processed, there is a limitation on a shape of the ink channel or there may be an error between processed ink channels.

When the ink channel is processed on the substrate, there is a limitation on the shape of the ink channel. More specifically, the shape of the nozzle is transferred to the shape of the ink channel using a method of processing an ink channel on the substrate. In general, flow resistance of a conduit is proportional to a length of the conduit and is inversely proportional to the square of a sectional area of the conduit. Flow resistance can be adjusted by adjusting the length of the conduit. However, it is difficult to adjust a flow resistance ratio of a nozzle and an ink channel that determine the performance of the ink-jet printhead using the back-shooting method because of requirements on those dimensions. Specifically, the length of the nozzle should be sufficiently long so that ink is stably ejected. In this case, the length of the ink channel should be sufficiently long. If the ink channel is processed through the nozzle, a processing time is increased. In addition, as the processing time is increased, the etching amount of a passivation layer formed under a heater is gradually increased. Thus, the thickness of the passivation layer should be excessively large.

When the ink channel is processed under the substrate, due to a step of a manifold, it is difficult to process the ink channel, and even though the ink channel may be processed, there may be an error between processed ink channels. In addition, the depth of the manifold is generally greater than 400 μm. In a structure having a large step, it is difficult to perform a photolithography process using an existing semiconductor device. First, when coating a photoresist, a photoresist that can be plated should be used, or a specific device, such as a spray coater, should be used. When exposing the photoresist, a specific device, such as a reconstructed projection aligner, and not a general exposure device, should be used. Further, even though the ink channel is processed using the aforementioned method, there is a larger error than in processing in which there is no step of the manifold. Since flow resistance is inversely proportional to the square of a sectional area of a conduit, even a small error in processing of the ink channel affects the performance of the ink-jet printhead.

SUMMARY OF THE INVENTION

The present invention provides an ink-jet printhead having improved efficiency and performance, and a method for manufacturing the same.

According to a feature of an embodiment of the present invention, there is provided an ink-jet printhead including a substrate, an ink chamber to be filled with ink to be ejected formed on an upper surface of the substrate, a restrictor, which is a path through which ink is supplied from an ink reservoir to the ink chamber, perforating a bottom surface of the substrate and a bottom surface of the ink chamber, a nozzle plate, which is stacked on the upper surface of the substrate and forms an upper wall of the ink chamber, a nozzle perforating the nozzle plate at a position corresponding to a center of the ink chamber, a heater formed in the nozzle plate to surround the nozzle, and a conductor for applying a current to the heater.

Preferably, the restrictor has a length of about 200-750 μm.

The heater may surround the nozzle and may be formed of one material selected from the group consisting of TaAl, TiN, CrN, W, and polysilicon. The conductor may be formed of aluminum or an aluminum alloy.

The nozzle plate may include a plurality of passivation layers. Here, the plurality of passivation layers may include a first passivation layer, a second passivation layer, and a third passivation layer, which are sequentially stacked on the substrate, and the heater may be disposed between the first passivation layer and the second passivation layer, and the conductor may be disposed between the second passivation layer and the third passivation layer. The passivation layers may be formed of at least one material selected from the group consisting of $SiO_2$, $Si_3N_4$, SiC, Ta, Pd, Au, TaO, TaN, Ti, TiN, $Al_2O_3$, CrN, or $RuO_2$.

The nozzle plate may further include a heat dissipating layer stacked on the plurality of passivation layers. Here, the heat dissipating layer may define an upper portion of the nozzle and may be formed of a metallic material having thermal conductivity to dissipate heat generated by the heater and heat remaining around the heater. The heat dissipating layer may be formed of at least one material selected from the group consisting of Ni, Fe, Au, Pd, and Cu, and the thickness of the heat dissipating layer may be greater than 10 μm.

According to another feature of an embodiment of the present invention, there is provided a method for manufacturing an ink-jet printhead including preparing a substrate, sequentially stacking a plurality of passivation layers on the substrate and forming a heater and a conductor connected to the heater between adjacent passivation layers, forming a heat dissipating layer on the plurality of passivation layers and forming a nozzle perforating the passivation layers and the heat dissipating layer, etching a bottom surface of the substrate and forming a restrictor in communication with an ink reservoir, and etching the substrate exposed through the nozzle to be in communication with the restrictor and forming an ink chamber to be filled with ink.

Here, sequentially stacking the plurality of passivation layers on the substrate and forming the heater and the conductor connected to the heater between adjacent passivation layers may include forming a first passivation layer on an upper surface of the substrate, forming the heater on the first passivation layer, forming a second passivation layer on the first passivation layer and the heater, forming the conductor on the second passivation layer, and forming a third passivation layer on the second passivation layer and the conductor.

In addition, forming the heat dissipating layer on the plurality of passivation layers and forming the nozzle perforating the plurality of passivation layers and the heat dissipating layer may include patterning the plurality of passivation layers and exposing an upper surface of the substrate, forming a sacrificial layer for forming the nozzle on the exposed substrate, forming a heat dissipating layer on the plurality of passivation layers, and removing the sacrificial layer and forming the nozzle.

The sacrificial layer may be formed of a photoresist.

The heat dissipating layer may be formed by electroplating, and the thickness of the heat dissipating layer may be greater than about 10 μm.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
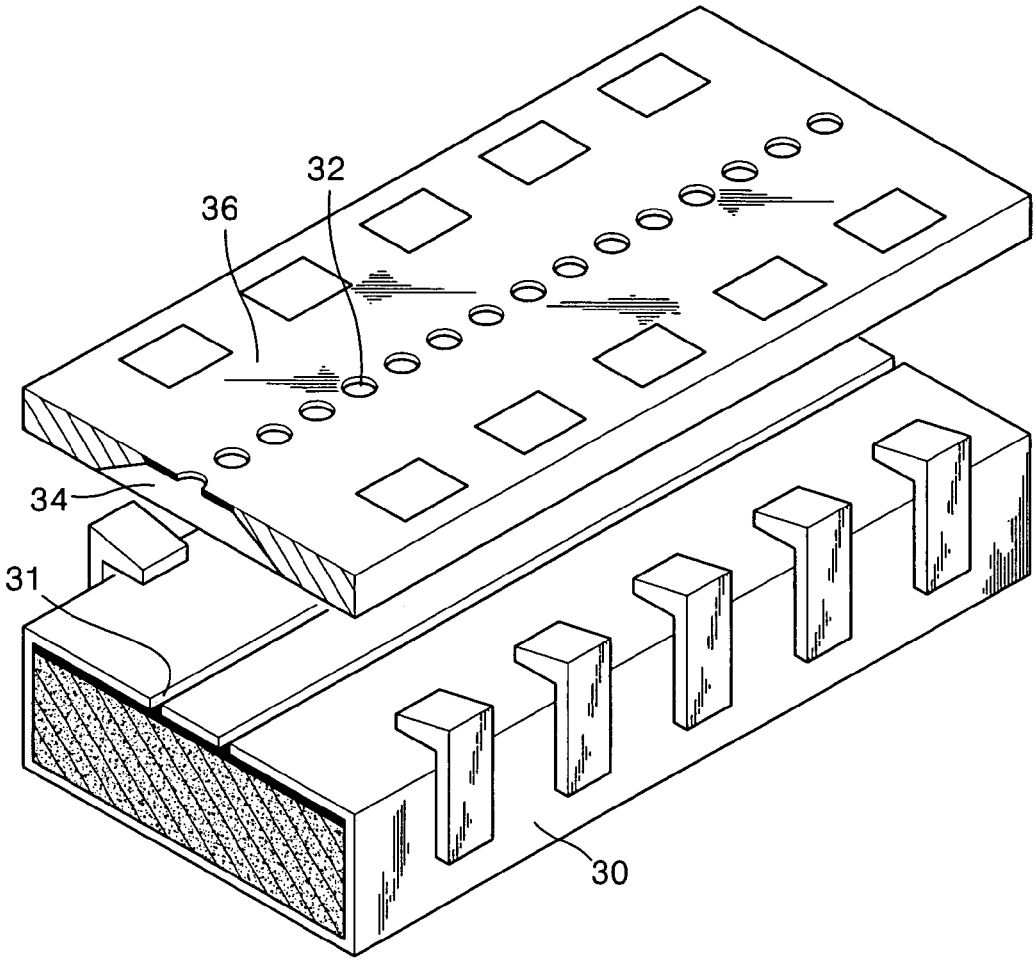
FIG. 1 (PRIOR ART)
FIGS. 1 through 4 illustrate various structures of conventional ink-jet printheads using the back-shooting method.
Figure 2:
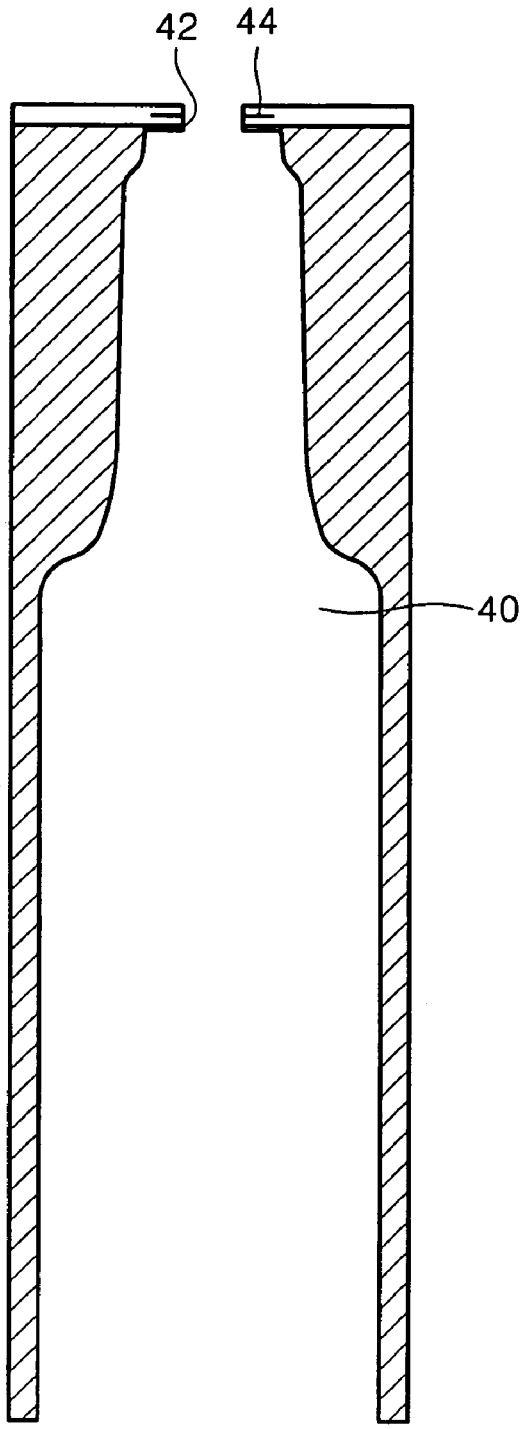
FIG. 2 (PRIOR ART)
Figure 3:
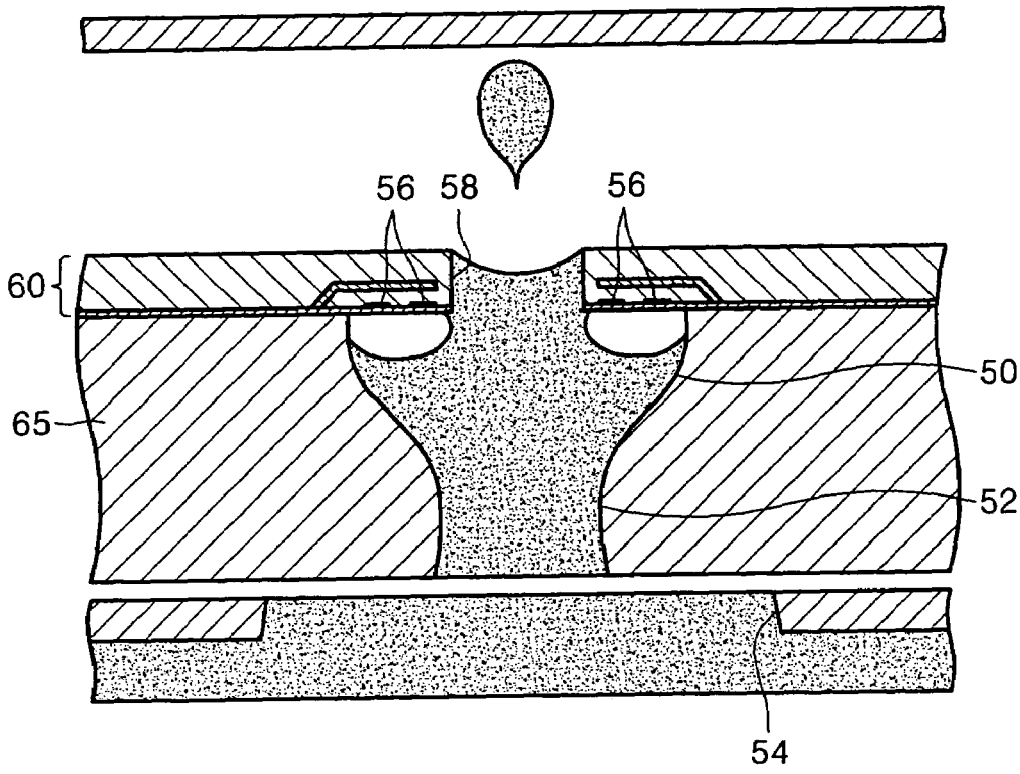
FIG. 3 (PRIOR ART)
Figure 4:
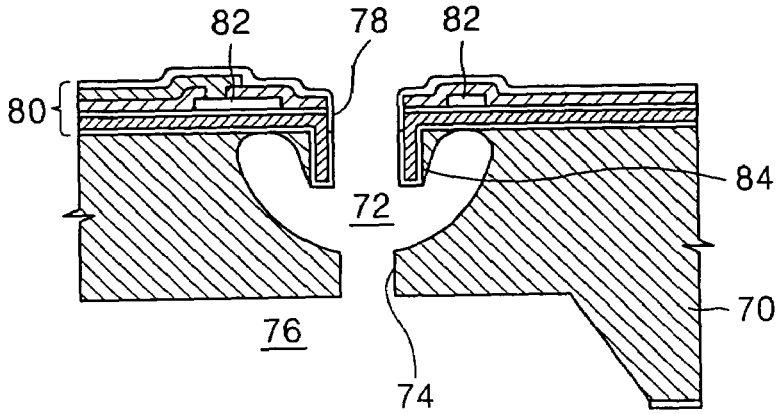
FIG. 4 (PRIOR ART)

Korean Patent Application No. 2003-8005, filed on Feb. 8, 2003, and entitled: "Ink-Jet Printhead and Method for Manufacturing the Same," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the thickness of layers and regions are exaggerated for clarity. It will also be understood that when a layer is referred to as being "on" another layer or substrate, it can be directly on the other layer or substrate, or intervening layers may also be present. In addition, it will also be understood that when a layer is referred to as being "between" two layers, it can be the only layer between the two layers, or one or more intervening layers may also be present. Like reference numerals refer to like elements throughout.

Figure 5:
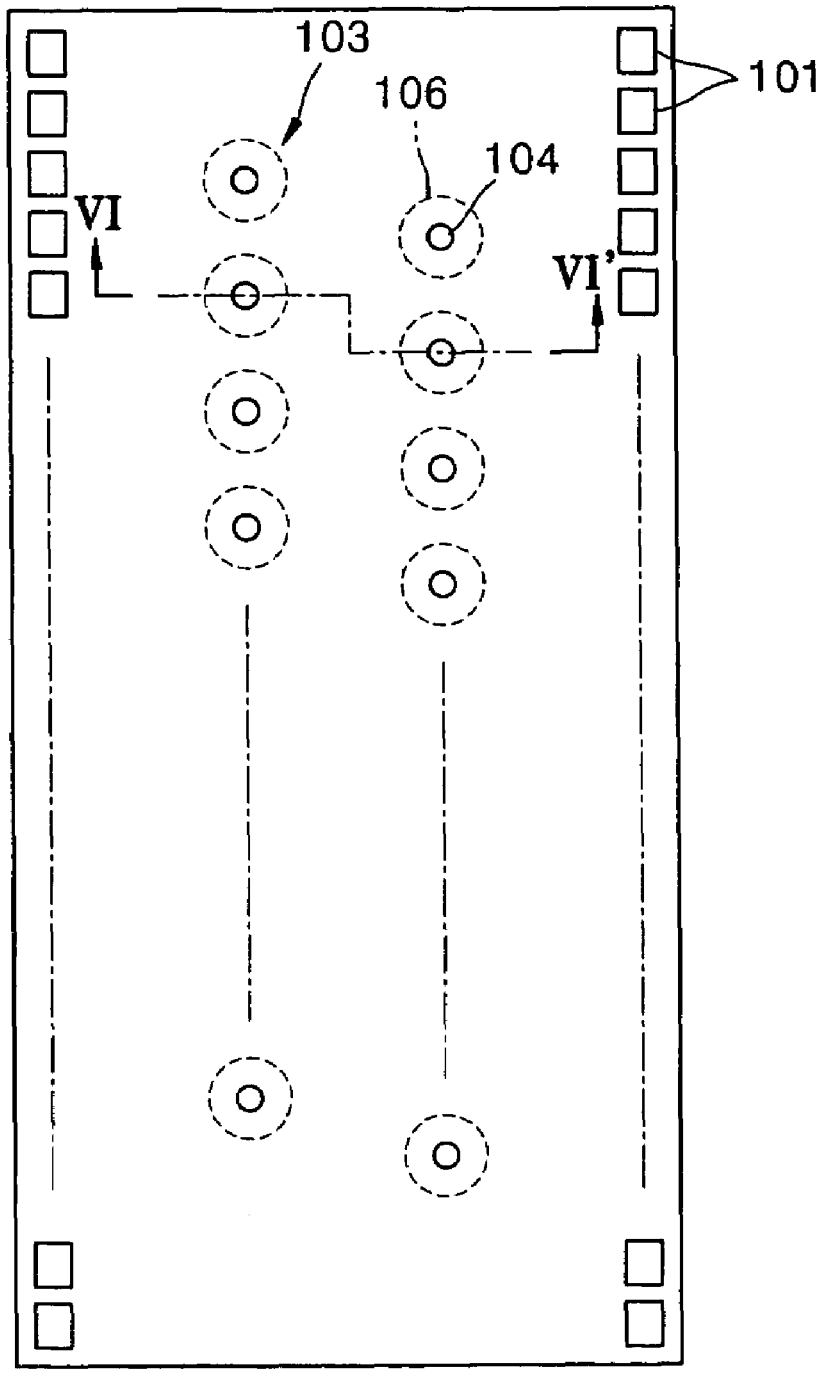
FIG. 5 illustrates a plan view of an ink-jet printhead according to an embodiment of the present invention.

FIG. 5 illustrates a plan view of an ink-jet printhead according to an embodiment of the present invention. Referring to FIG. 5, the ink-jet printhead includes ink ejecting portions 103 disposed in two rows and bonding pads 101, each of which is electrically connected to a corresponding one of the ink ejecting portions 103. Each ink ejecting portion 103 includes a nozzle 104 and an ink chamber 106. In FIG. 5, the ink ejecting portions 103 are disposed in an exemplary two rows. The ink ejecting portions 103 may alternately be disposed in one row or in three or more rows to improve printing resolution.

Figure 6:
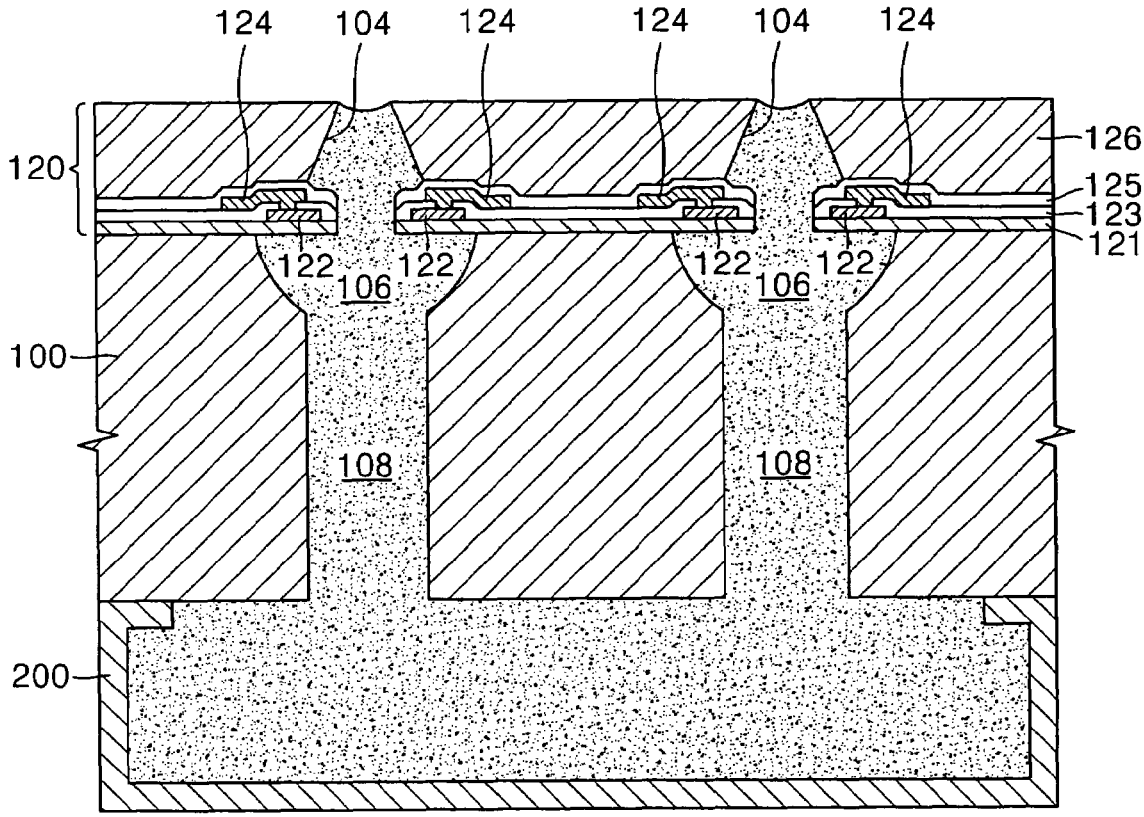
FIG. 6 illustrates a cross-sectional view taken along line VI-VI' of FIG. 5.

FIG. 6 illustrates a cross-sectional view taken along line VI-VI' of FIG. 5.

The structure of an ink-jet printhead according to the embodiment of the present invention will be described in detail with reference to FIG. 6.

First, an ink chamber 106, which is to be filled with ink, having a substantially hemispherical shape is formed on an upper surface of a substrate 100. Here, a silicon wafer that is widely used to manufacture integrated circuits (ICs) may be used as the substrate 100.

A restrictor 108 for supplying ink to the ink chamber 106 is perforated through a bottom surface of the substrate 100 and a bottom surface of the ink chamber 106 to be perpendicular to the bottom surface of the ink chamber 106. Preferably, the restrictor 108 has a length of about 200-750 μm. The restrictor 108 is an ink passage that provides communication between an ink reservoir 200 formed on the bottom surface of the substrate 100 and the ink chamber 106 to be filled with ink to be ejected. Thus, unlike a conventional ink-jet printhead that has a structure in which ink is supplied to an ink chamber through a manifold and an ink channel, the ink-jet printhead according to the present invention directly supplies ink to the ink chamber 106 from the ink reservoir 200 through the restrictor 108.

A nozzle plate 120 is formed on the substrate 100 and forms an upper wall of the ink chamber 106. The nozzle plate 120 is formed of a plurality of material layers stacked on the substrate 100. The plurality of material layers includes first, second, and third passivation layers 121, 123, and 125, and a heat dissipating layer 126. A heater 122 is disposed between the first passivation layer 121 and the second passivation layer 123. A conductor 124 for supplying a current to the heater 122 is disposed between the second passivation layer 123 and the third passivation layer 125.

The first passivation layer 121 is a lowermost material layer of the plurality of material layers that are components of the nozzle plate 120, and is formed on the upper surface of the substrate 100. The first passivation layer 121 is a material layer for providing insulation between the heater 122 formed on the first passivation layer 121 and the substrate 100 formed under the first passivation layer 121 and for providing passivation of the heater 122. The first passivation layer 121 may be formed of a material selected from $SiO_2$, $Si_3N_4$, SiC, Ta, Pd, Au, TaO, TaN, Ti, TiN, $Al_2O_3$, CrN, and $RuO_2$, or a stack material thereof.

The heater 122, which heats ink in the ink chamber 106, is disposed on the first passivation layer 121 and surrounds a nozzle 104. The heater 122 is formed of a resistance heating material, such as TaAl, TiN, CrN, W, or polysilicon.

The second passivation layer 123 is formed on the first passivation layer 121 and the heater 122. The second passivation layer 123 is a material layer for providing insulation between the conductor 124, formed on the second passivation layer 123, and the heater 122, formed under the second passivation layer 123, and for providing passivation of the heater 122. The second passivation layer 123 may be formed of the same material as the first passivation layer 121.

The conductor 124, which is electrically connected to the heater 122 and applies a pulse current to the heater 122, is formed on the second passivation layer 123. A first end of the conductor 124 is connected to the heater 122 via a contact hole formed in the second passivation layer 123. A second end of the conductor 124 is electrically connected to a bonding pad (101 of FIG. 5). The conductor 124 may be formed of metal having good conductivity, for example, aluminum (Al) or an aluminum alloy.

A third passivation layer 125 is formed on the second passivation layer 123 and the conductor 124. The third passivation layer 125 may be formed of the same material as the first and second passivation layers 121 and 123.

A heat dissipating layer 126 is formed on the third passivation layer 125. The heat dissipating layer 126 is an uppermost material layer of the plurality of material layers that are components of the nozzle plate 120 and dissipates heat generated by the heater 122 and heat remaining around the heater 122. Thus, preferably, the heat dissipating layer 126 is formed of a metallic material having good thermal conductivity, such as Ni, Fe, Au, Pd, or Cu. The heat dissipating layer 126 is formed to have a relatively larger thickness of greater than about 10 μm by electroplating the above-described metallic material. To perform the electroplating, a seed layer (not shown) for electroplating of the above-described metallic material may be formed between the third passivation layer 125 and the heat dissipating layer 126. The seed layer may be formed of a metallic material having good electrical conductivity, such as Cr, Ti, Ni, or Cu.

Meanwhile, the nozzle 104, through which ink is ejected from the ink chamber 106, vertically perforates the nozzle plate 120 at a position corresponding to a center of the ink chamber 106. A lower portion of the nozzle 104 has a cylindrical shape and is formed in the first, second, and third passivation layers 121, 123, and 125. An upper portion of the nozzle 104 has a tapered shape such that a diameter thereof decreases as the nozzle 104 extends toward an outlet, and is formed in the heat dissipating layer 126. When the upper portion of the nozzle 104 has a tapered shape, a meniscus of the surface of ink is more quickly stabilized after ink is ejected.

Hereinafter, an operation of ejecting ink in the ink-jet printhead having the above structure will be described.

First, when a pulse current is applied to the heater 122 via the conductor 124 in a state in which ink fills the restrictor 108, the ink chamber 102, and the nozzle 104, the heater 122 generates heat. Heat is transferred to ink in the ink chamber 106 through the first passivation layer 121 formed under the heater 122. As a result, ink is boiled, and a bubble is generated in ink. The bubble expands due to a continuous supply of heat. As a result, ink is ejected through the nozzle 104. In this case, due to the restrictor 108, flow resistance is increased in a direction of bubble growth. Thus, energy of a bubble may be more effectively used to eject ink from the ink chamber 106.

Next, when the expanded bubble reaches a maximum size and the applied current is cut off, the bubble contracts and collapses. When this occurs, a negative pressure is applied to ink in the ink chamber 106 such that ink in the nozzle 104 is returned to an interior of the ink chamber 106. Simultaneously, ink ejected through the nozzle 104 is separated from ink in the nozzle 104 by an inertia force and is ejected in droplet form.

Finally, when the negative pressure in the ink chamber disappears due to a surface tension acting on a meniscus formed in the nozzle 104, ink ascends toward an outlet end of the nozzle 104. As such, the ink chamber 106 is refilled with ink supplied from the ink reservoir 200 through the restrictor 108. After an ink refill operation is completed and the ink-jet printhead is returned to an initial state, the above-described operation is repeated.

Hereinafter, a method for manufacturing an ink-jet printhead according to an embodiment of the present invention will be described.

FIGS. 7 through 17 illustrate stages in a method for manufacturing an ink-jet printehad according to an embodiment of the present invention.

Figure 7:
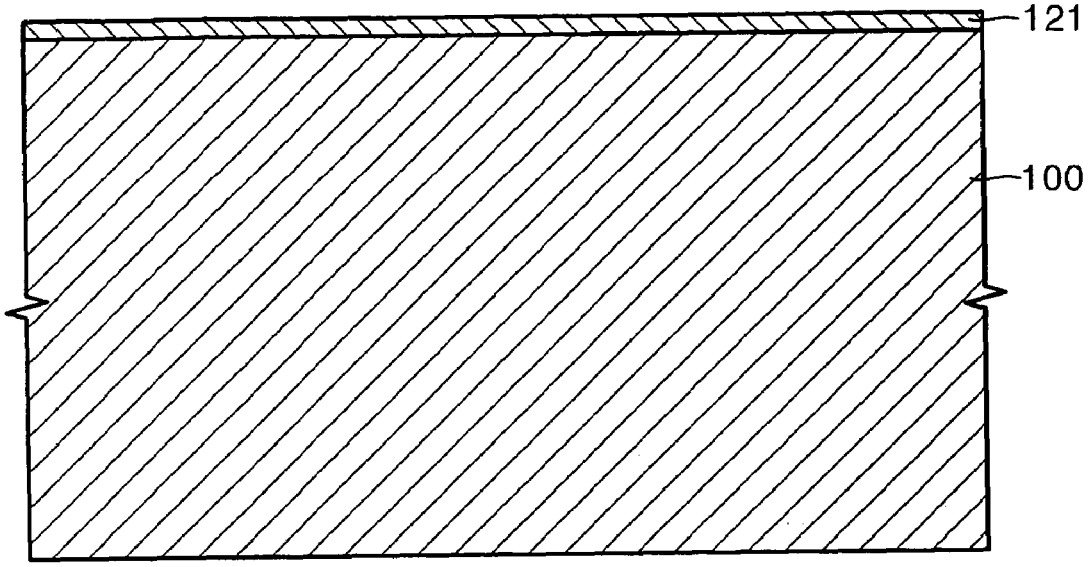
FIGS. 7 through 17 illustrate stages in a method for manufacturing an ink-jet printehad according to an embodiment of the present invention.

First, referring to FIG. 7, a silicon wafer is processed and is used as the substrate 100. A silicon wafer is widely used to manufacture semiconductor devices, and thus, is effective in mass production of a printhead.

FIG. 7 illustrates only a portion of a silicon wafer. An ink-jet printhead according to the present invention may be manufactured as several tens to hundreds of chips in a single wafer.

The first passivation layer 121 is initially formed on the upper surface of the substrate 100. The first passivation layer 121 may be formed of a material selected from $SiO_2$, $Si_3N_4$, SiC, Ta, Pd, Au, TaO, TaN, Ti, TiN, $Al_2O_3$, CrN, and $RuO_2$, or a stack material thereof.

Figure 8:
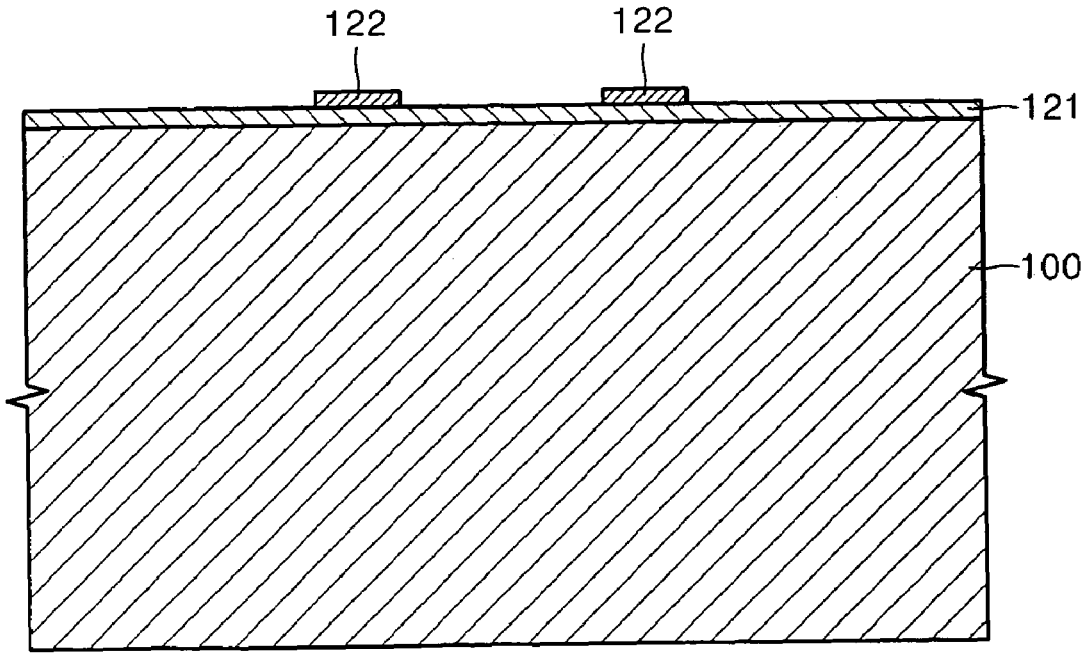

Next, as shown in FIG. 8, the heater 122 is formed on the fist passivation layer 121 formed on the upper surface of the substrate 100. The heater 122 is formed by depositing a resistance heating material, such as TaAl, TiN, CrN, W, or polysilicon, over the entire surface of the first passivation layer 121 to a predetermined thickness and patterning a deposited resultant in a ring shape.

Figure 9:
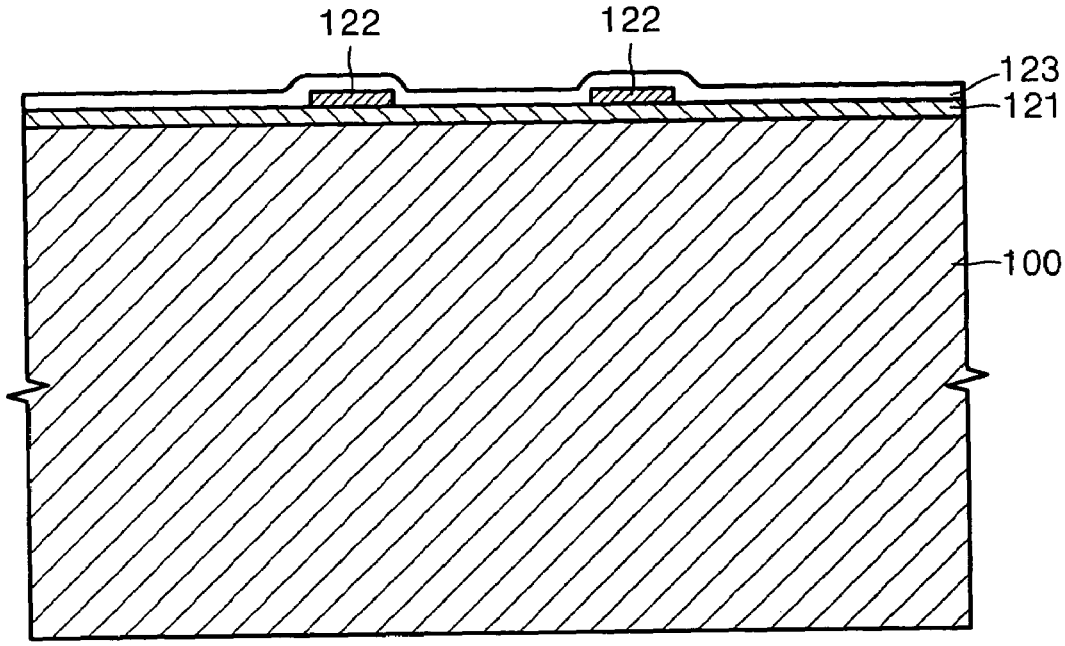

Subsequently, as shown in FIG. 9, the second passivation layer 123 is formed on top surfaces of the first passivation layer 121 and the heater 122. The second passivation layer 123 may be formed of the same material as the first passivation layer 121.

Figure 10:
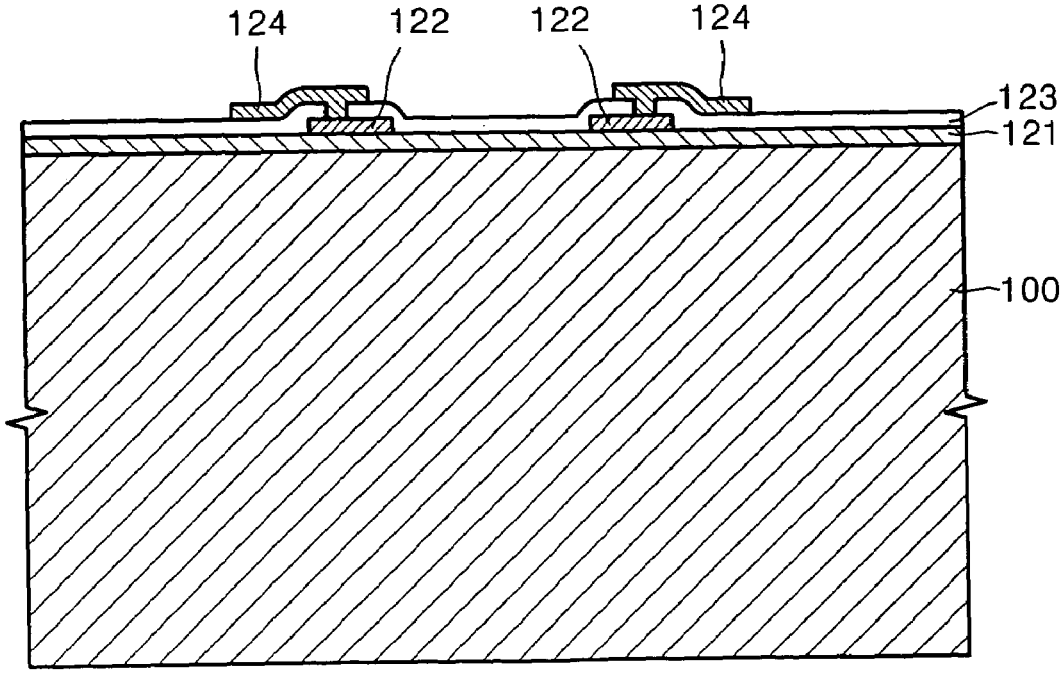

Next, as shown in FIG. 10, the conductor 124 is formed on the second passivation layer 123. Specifically, the conductor 124 may be formed by partially etching the second passivation layer 123, forming a contact hole through which part of the heater 122, that is, a portion of the heater 122 to be connected to the conductor 124, is exposed, depositing metal having good electrical conductivity, such as aluminum (Al) or an aluminum alloy, on the top surface of the second passivation layer 123 to a predetermined thickness using sputtering and patterning a deposited resultant.

Figure 11:
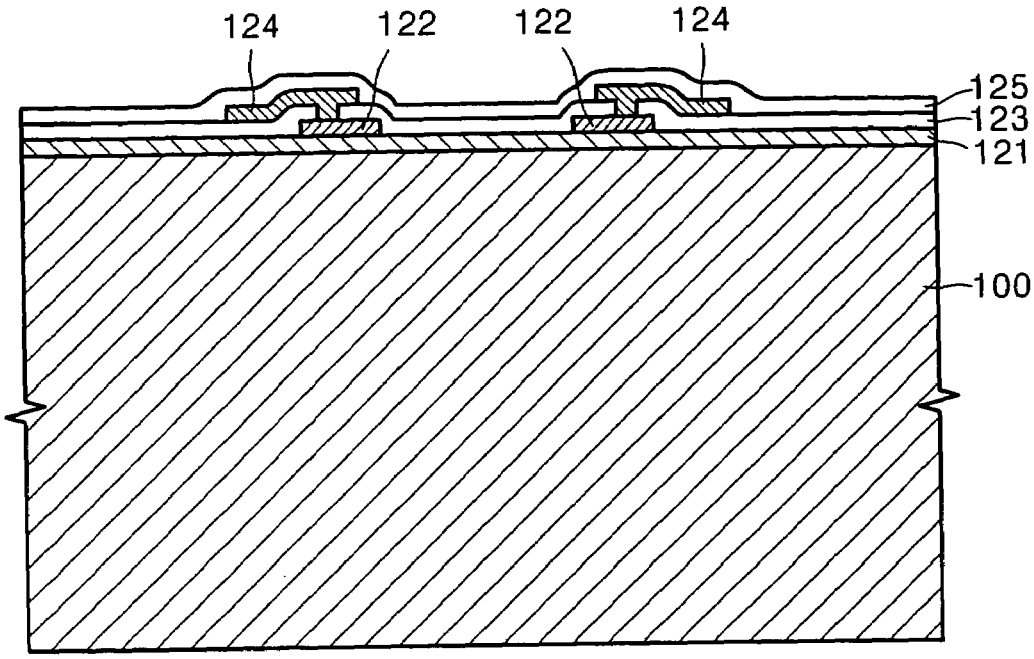

Next, as shown in FIG. 11, the third passivation layer 125 is formed on the second passivation layer 123 and the conductor 124. The third passivation layer 125 may be formed of the same material as the first and second passivation layers 121 and 123.

Figure 12:
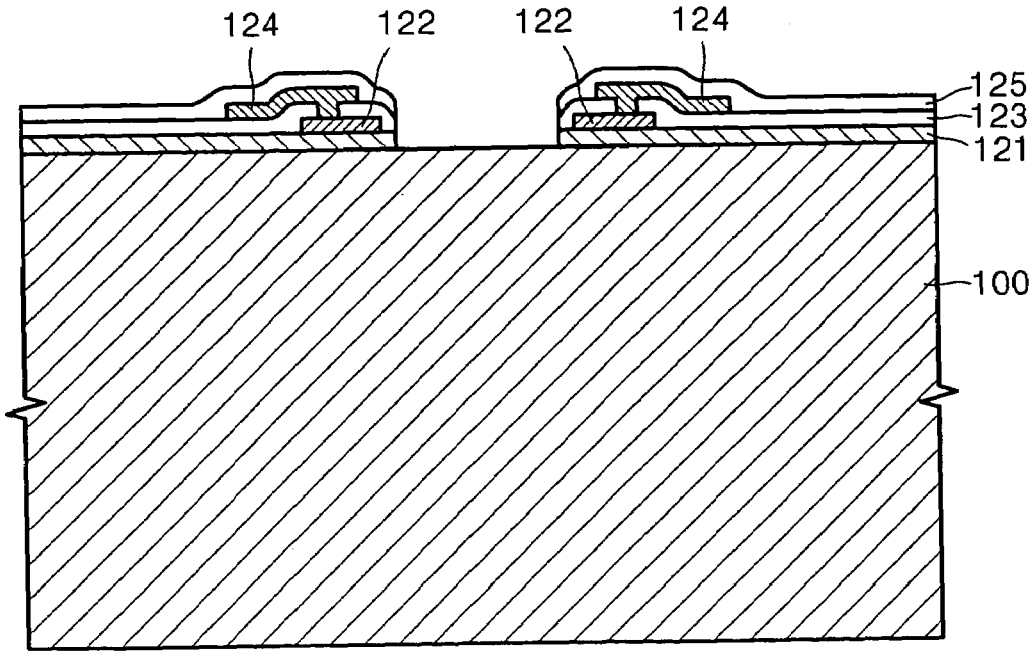

Subsequently, as shown in FIG. 12, the first, second, and third passivation layers 121, 123, and 125 are etched to expose the upper surface of the substrate 100, thereby forming a lower portion of the nozzle 104. Specifically, the lower portion of the nozzle 104 may be formed by sequentially etching the third passivation layer 125, the second passivation layer 123, and the first passivation layer 121 within an interior of the ring-shaped heater 122 using reactive ion etching (RIE).

Figure 13:
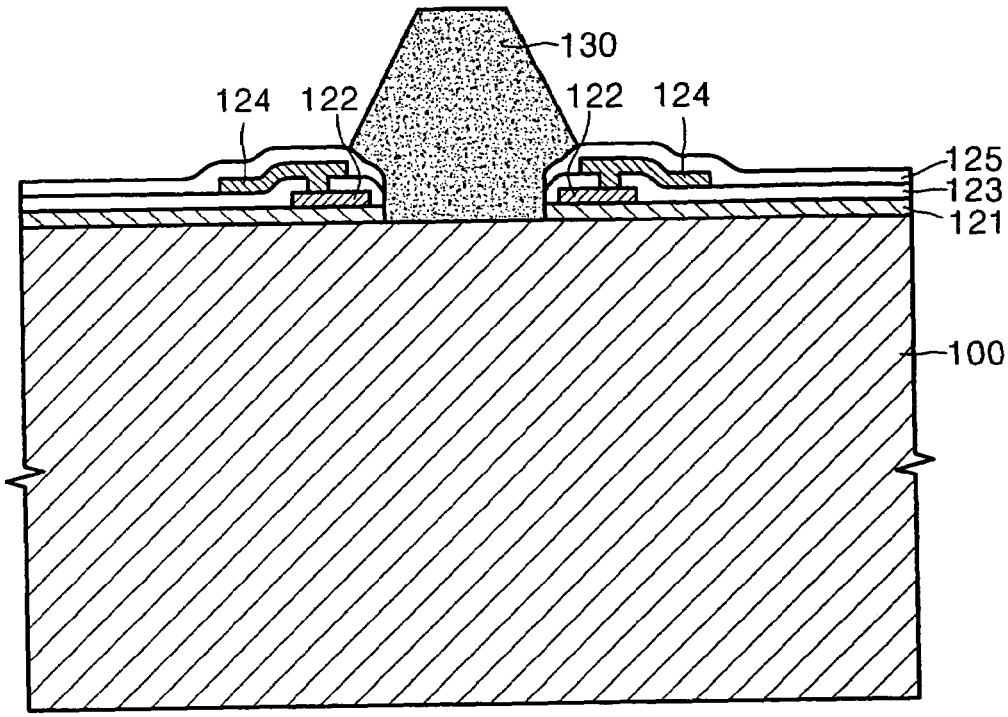

Next, as shown in FIG. 13, a sacrificial layer 130 for forming the nozzle 104 is formed on the exposed substrate 100. The sacrificial layer 130 is formed of a photoresist. Specifically, the photoresist is coated over the entire surface of a resultant of FIG. 12, and a coated resultant is patterned in a predetermined shape so that only photoresist in a location that corresponds to a portion where the nozzle 104 is to be formed remains.

Figure 14:
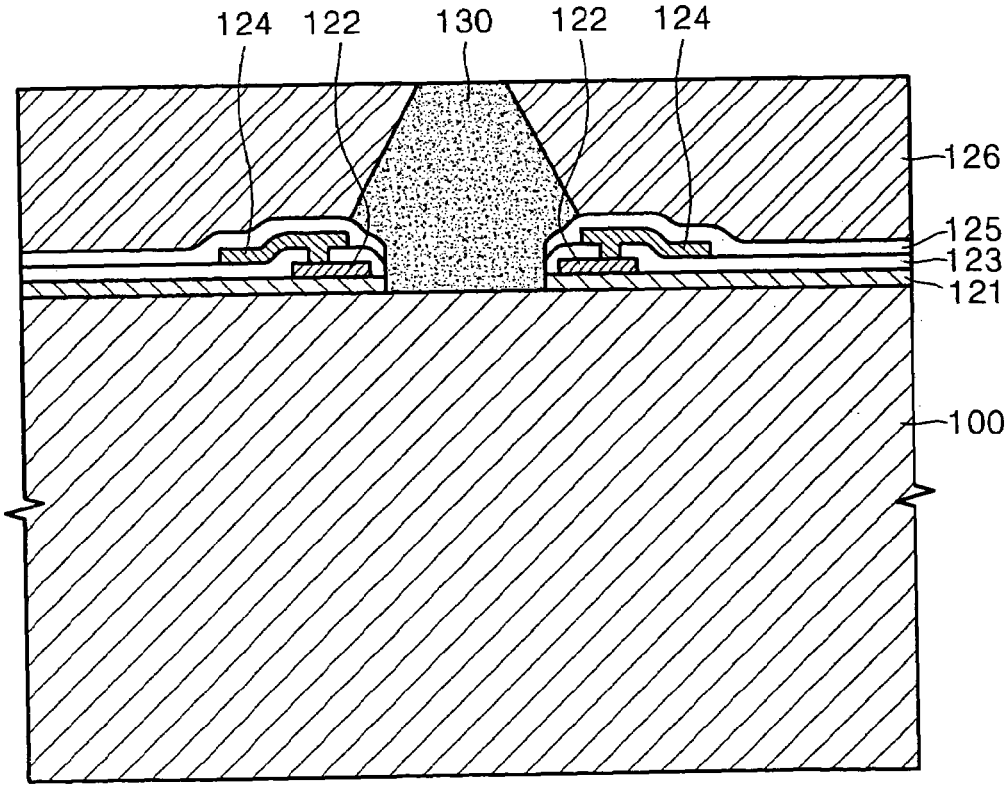

Subsequently, although not shown, a seed layer for electroplating the heat dissipating layer 126 of FIG. 14 is formed on a top surface of the third passivation layer 125. For electroplating, the seed layer may be formed by depositing metal having good conductivity, such as Cr, Ti, Ni, or Cu, to a thickness of about 500-2000 Å through sputtering.

Next, as shown in FIG. 14, the heat dissipating layer 126 formed of a metallic material having a predetermined thickness is formed on a top surface of the seed layer. The heat dissipating layer 126 may be formed by electroplating metal having good thermal conductivity, such as Ni, Fe, Au, Pd, or Cu, on the top surface of the seed layer. In this case, preferably, the thickness of the heat dissipating layer 126 is greater than about 10 μm. Meanwhile, a surface of the heat dissipating layer 126 after electroplating is completed is uneven due to material layers formed under the heat dissipating layer 126. Thus, the surface of the heat dissipating layer 126 may be planarized by a chemical mechanical polishing (CMP) process.

Figure 15:
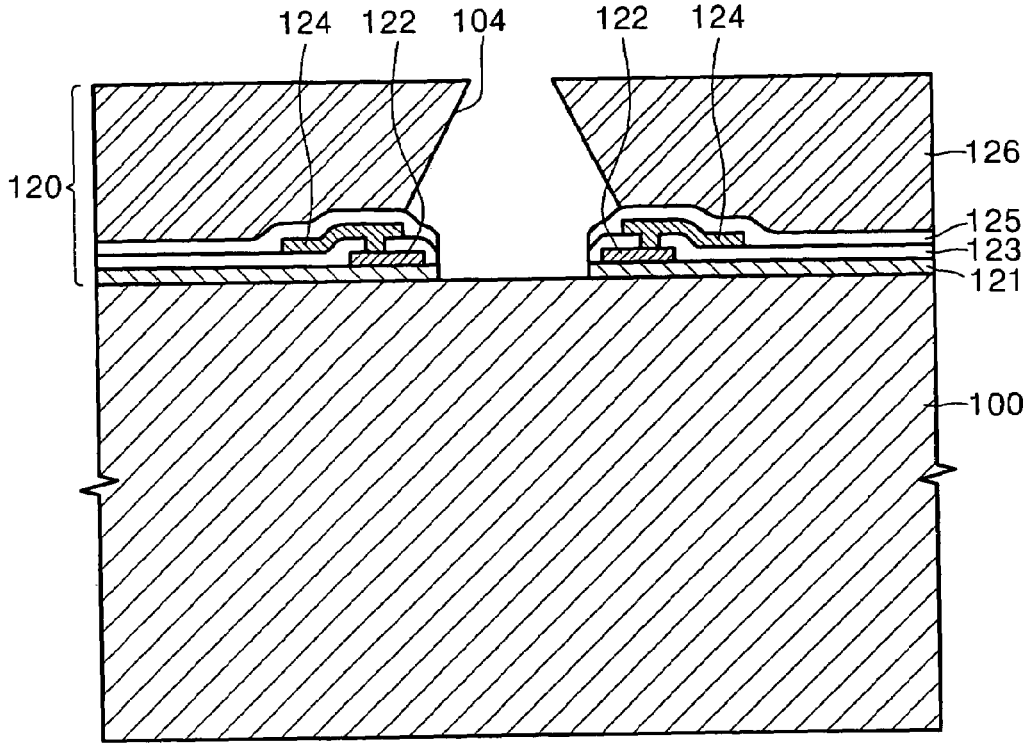

Subsequently, as shown in FIG. 15, the sacrificial layer 130 is etched to form the nozzle 104. As such, the nozzle plate 120 formed of a plurality of material layers is formed.

Figure 16:
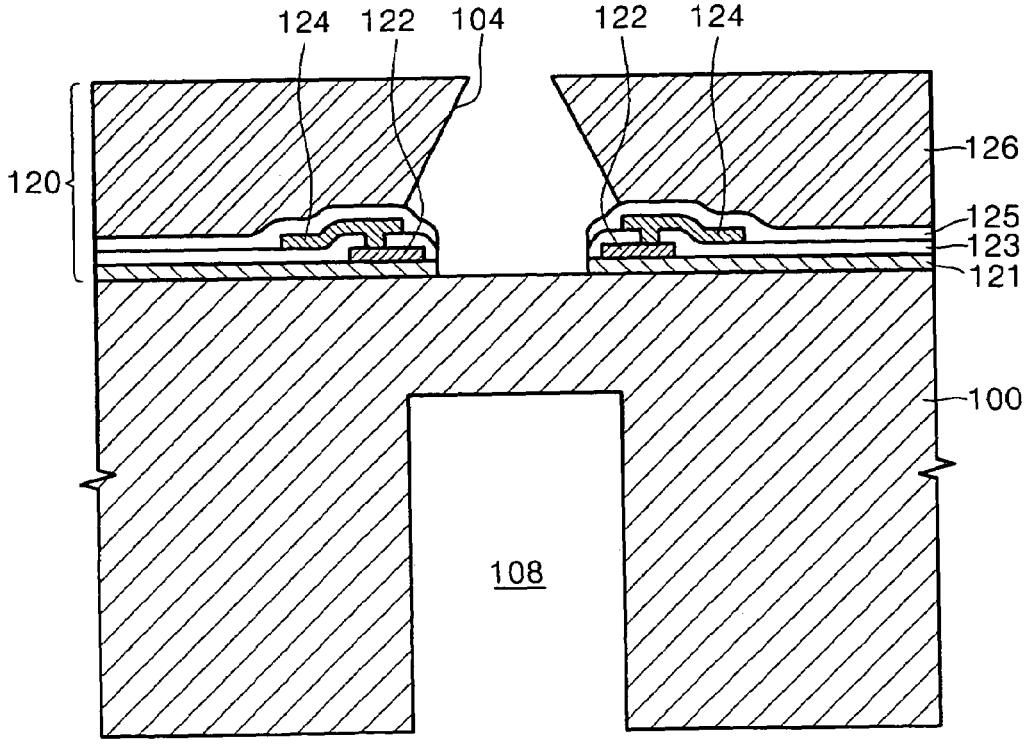

Next, as shown in FIG. 16, a bottom surface of the substrate 100 is etched to form the restrictor 108. The restrictor 108 may be formed by etching the bottom surface of the substrate 100 using inductively coupled plasma (ICP). Preferably, a length of the restrictor 108 is about 200-750 μm. Meanwhile, the restrictor 108 may be formed by wet etching. In this case, for a next process, a passivation layer may be deposited on the bottom surface of the substrate 100 on which the restrictor 108 is formed. The passivation layer is an etch mask for etching silicon and may be formed of a polymer, such as $C_xH_y$, $C_xF_y$, or $C_xH_yF_2$, or an insulating material, such as $SiO_2$, $Si_3N_4$, or SiC.

Figure 17:
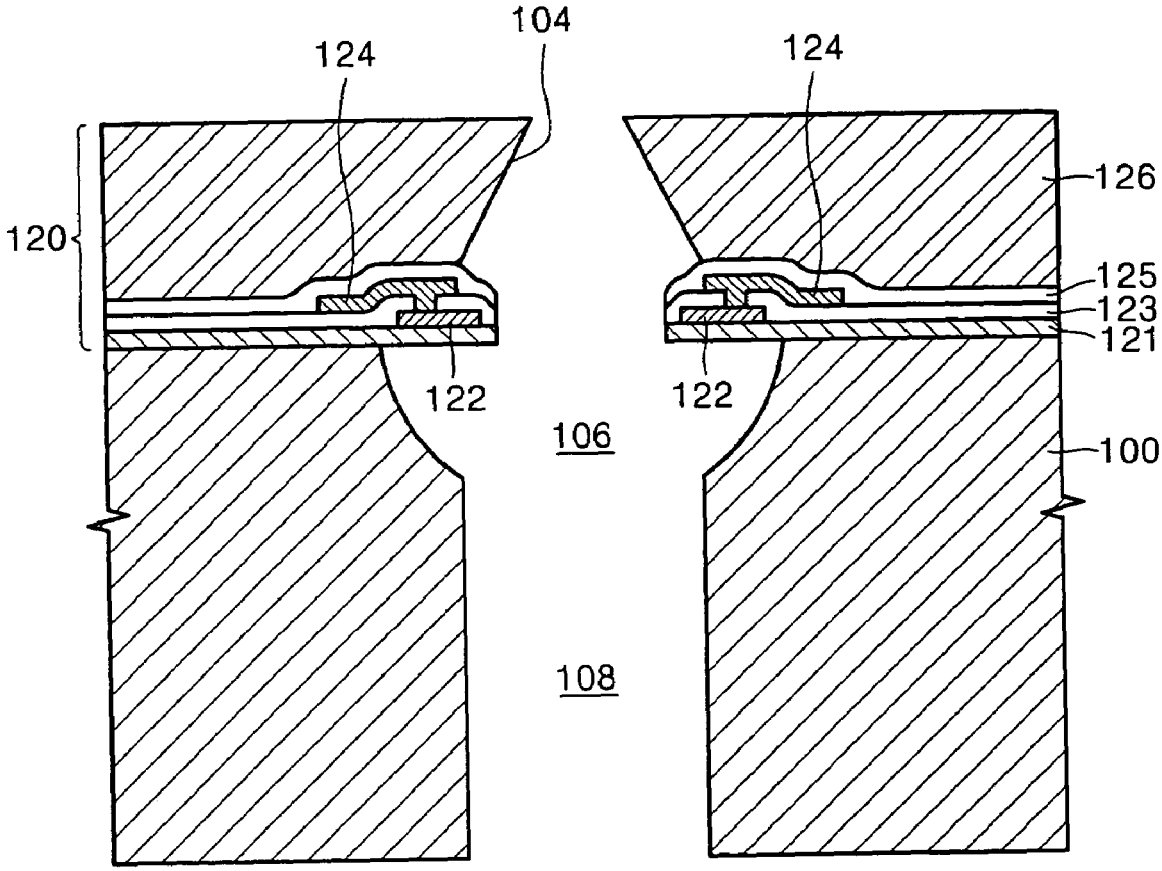

Next, as shown in FIG. 17, the ink chamber 106 to be filled with ink is formed on the upper surface of the substrate 100. The ink chamber 106 may be formed by isotropically etching the upper surface of the substrate 100 exposed through the nozzle 104. Specifically, the ink chamber 106 is formed by dry etching the surface of the substrate 100 using an etch gas, such as an $XeF_2$ gas or a $BrF_3$ gas. In this case, the ink chamber 106 has a substantially hemispherical shape and is in communication with the restrictor 108.

As described above, the ink-jet printhead and the method for manufacturing the same according to the embodiment of the present invention have the following advantageous effects. First, an ink chamber and a restrictor are formed on a substrate such that an efficiency of a printhead using a back-shooting method is improved. Second, a portion of the substrate is etched, thereby forming the ink chamber such that a restriction on an operating frequency caused by a large ink chamber is removed. Third, a manifold formed on the substrate in the prior art is removed such that a more uniform restrictor is manufactured. As such, the yield of the printhead is improved, and a difference in performance between nozzles in the same chip is reduced. Fourth, a process of manufacturing the ink-jet printhead is simplified, and an additional device other than a conventional device for manufacturing an ink-jet printhead is not added, thereby reducing costs for the restrictor.

Exemplary embodiments of the present invention have been disclosed herein and, although specific terms are employed, they are used and are to be interpreted in a generic and descriptive sense only and not for purpose of limitation. For example, although an exemplary material used in forming each element of an ink-jet printhead according to the present invention has been described, a variety of materials may be used to form elements. For example, a variety of materials having good processing properties other than silicon may be used to form a substrate. Similarly, a variety of materials may be used to form a heater, a conductor, a passivation layer, or a heat dissipating layer. In addition, although an exemplary method for depositing and forming each material has been described, a variety of deposition and etch methods may be applied to an ink-jet printhead according to the present invention. Further, specific values exemplified above may be varied within a range where the ink-jet printhead can operate normally. In addition, the order of each step of the method for manufacturing the ink-jet printhead may be varied. Accordingly, it will be understood by those of ordinary skill in the art that various changes in form and details may be made without departing from the spirit and scope of the present invention as set forth in the following claims.

What is claimed is:

1. An ink-jet printhead, comprising:

a substrate;

an ink chamber to be filled with ink to be ejected formed on an upper surface of the substrate;

a restrictor defining a path through which ink is supplied from an ink reservoir to the ink chamber, the restrictor perforating a bottom surface of the substrate and a bottom surface of the ink chamber, and having a cross-sectional area that is less than that of the ink chamber and less than that of the ink reservoir;

a nozzle plate, which is stacked on the upper surface of the substrate and forms an upper wall of the ink chamber;

a nozzle perforating the nozzle plate at a position corresponding to a center of the ink chamber;

a heater formed in the nozzle plate to surround the nozzle; and a conductor for applying a current to the heater.

2. The ink-jet printhead as claimed in claim 1, wherein the restrictor has a length of about 200-750 μm.

3. The ink-jet printhead as claimed in claim 1, wherein the heater is formed of one material selected from the group consisting of TaAl, TiN, CrN, W, and polysilicon.

4. The ink-jet printhead as claimed in claim 1, wherein the conductor is formed of aluminum or an aluminum alloy.

5. The ink-jet printhead as claimed in claim 1, wherein the nozzle plate includes a plurality of passivation layers.

6. The ink-jet printhead as claimed in claim 5, wherein the plurality of passivation layers includes a first passivation layer, a second passivation layer, and a third passivation layer, which are sequentially stacked on the substrate, and wherein the heater is disposed between the first passivation layer and the second passivation layer, and the conductor is disposed between the second passivation layer and the third passivation layer.

7. The ink-jet printhead as claimed in claim 5, wherein each of the plurality of passivation layers is formed of at least one material selected from the group consisting of $SiO_2$, $Si_3N_4$, SiC, Ta, Pd, Au, TaO, TaN, Ti, TiN, $Al_2O_3$, CrN, and $RuO_2$.

8. The ink-jet printhead as claimed in claim 5, wherein the nozzle plate further includes a heat dissipating layer stacked on the plurality of passivation layers.

9. The ink-jet printhead as claimed in claim 8, wherein the heat dissipating layer defines an upper portion of the nozzle and is formed of a metallic material having thermal conductivity to dissipate heat generated by the heater and heat remaining around the heater.

10. The ink-jet printhead as claimed in claim 9, wherein the heat dissipating layer is formed of at least one material selected from the group consisting of Ni, Fe, Au, Pd, and Cu.

11. The ink-jet printhead as claimed in claim 8, wherein the heat dissipating layer has a thickness greater than about 10 μm.

12. The ink-jet printhead as claimed in claim 1, wherein:

a plurality of restrictors perforate the bottom surface of the substrate, and the bottom surface of the substrate extends across an open side of the ink chamber, such that the plurality of restrictors are within the perimeter of the open side.

13. The ink-jet printhead as claimed in claim 12, wherein:

the bottom surface of the substrate is substantially planar in a region perforated by the plurality of restrictors, and the bottom surface of the substrate is exposed to ink in the ink reservoir, such that ink is supplied directly from the ink reservoir to the plurality of restrictors.

* * * * *